United States Patent [19]

Kraeutler

[11] Patent Number: 4,828,003

[45] Date of Patent: May 9, 1989

[54] SUPPORT AND TRANSMISSION MODULE FOR THE WINDING SHAFT OF A LIFTING CURTAIN DOOR

[75] Inventor: Bernard Kraeutler, Dunieres, France

[73] Assignee: Nergeco (SA), Dunieres, France

[21] Appl. No.: 76,085

[22] Filed: Jul. 21, 1987

[30] Foreign Application Priority Data

Jul. 23, 1986 [FR] France ..... 86 10736
May 7, 1987 [FR] France ..... 87 06465

[51] Int. Cl.[4] ..... A47H 5/14
[52] U.S. Cl. ..... 160/84.1; 160/331
[58] Field of Search ..... 160/84.1, 310, 311, 160/312, 188, 189, 331; 74/421 A, 421 R; 464/106, 147, 155, 156, 158

[56] References Cited

U.S. PATENT DOCUMENTS

| | | | |
|---|---|---|---|
| 1,260,371 | 3/1918 | Goss | 160/189 |
| 1,900,677 | 3/1933 | Weidhaas et al. | 160/84.1 X |
| 2,076,015 | 4/1937 | Broome | 74/421 A |
| 2,626,375 | 1/1953 | Fischer | 160/331 X |
| 2,676,654 | 4/1954 | Vallen | 160/331 |
| 3,006,352 | 10/1961 | Hozak | 160/310 X |
| 3,054,275 | 9/1962 | Ongaro | 464/156 |
| 3,073,176 | 1/1963 | Daugirdas | 74/421 A |
| 3,512,302 | 5/1970 | Sivin et al. | 160/310 X |
| 3,937,096 | 2/1976 | Lundin et al. | 74/421 A |
| 3,940,946 | 3/1976 | Andersen | 464/156 X |
| 4,037,526 | 7/1977 | Jaekle | 160/310 X |
| 4,062,519 | 12/1977 | Jacobs | 160/331 |
| 4,147,071 | 4/1979 | Scribner et al. | 74/421 A |
| 4,530,674 | 7/1985 | Rauch | 464/147 X |
| 4,541,160 | 9/1985 | Roberts | 464/162 |
| 4,718,471 | 1/1988 | Kraeutler | 160/331 X |
| 4,727,919 | 3/1988 | Kraeutler | 160/310 X |

*Primary Examiner*—Robert W. Gibson, Jr.
*Assistant Examiner*—David M. Purol
*Attorney, Agent, or Firm*—Sughrue, Mion, Zinn, Macpeak & Seas

[57] ABSTRACT

A support and transmission module (25) for the winding shaft (23) of a lifting curtain door, said shaft being rotated by an electric motor, comprises a closed case (30) containing at least two parallel module shafts (31, 33, 35). A primary module shaft (31) and a secondary module shaft (33) are colinearly connectable to the outlet shaft (32) of the motor and to the winding shaft (23), respectively. These module shafts carry toothed wheels (42, 43, 44, 45) which cause them to rotate together. They transmit torque generated by the motor (27) to the winding shaft (23) and they reduce the speed of rotation of said motor. Such a module is reliable and can be prefabricated industrially and fitted to any type of lifting curtain door, and makes it possible, in combination with another, similar module, to replace the score of parts normally required for providing a system for supporting and driving the winding shaft of a lifting curtain door.

4 Claims, 6 Drawing Sheets

SUPPORT AND TRANSMISSION MODULE FOR THE WINDING SHAFT OF A LIFTING CURTAIN DOOR

The present invention relates to a support and transmission module for the winding shaft of a lifting curtain door.

BACKGROUND OF THE INVENTION

The invention relates to all kinds of lifting curtain doors including a winding shaft which is rotated by a motor external to said shaft. Doors of this type are used essentially for two distinct and incompatible purposes: some are intended to provide protection against intrusion, in which case the curtains are rigid and are generally constituted of hinged metal gratings or sheets which are relatively heavy and which operate relatively slowly; others are intended to facilitate goods handling while constituting a thermal screen, in which case they comprise flexible curtains which are generally made of plastified cloth (or of plastic film) which may optionally be stiffened at regular intervals by horizontal reinforcing bars, but which are light and which operate rapidly. Apart from their different purposes and their different constructions, all such doors to which the invention is equally applicable include a winding shaft on which either the curtain itself is wound (as is the case for protective doors and some handling doors) or else curtain-lifting straps are wound (as is the case for concertina-type handling doors, for example).

In order to explain in detail how the winding shaft of a lifting curtain door is normally supported and driven, regardless of whether the door is for handling purposes or for protection purposes, FIG. 1 is a diagrammatic perspective view of the top of a handling door whose shaft is used for winding up lifting straps. This door may be a concertine-type door, for example, having its curtain 1 constituted by a rectangle of plastified cloth which is stiffened at regular intervals by horizontal reinforcing bars (not shown). The curtain is lifted by the straps 2 each having one end connected to the bottom reinforcing bar and having its other end fixed on a winding shaft 3. The straps also pass through guides in the form of rectangular loops which are fixed on all odd-numbered reinforcing bars counting from the bottom bar. As a result, when the straps 2 are wound onto the shaft 3, the flexible curtain 1 is raised while being folded concertina-like. The door shown in FIG. 1 comprises two channel section vertical risers 4 receiving the ends of the reinforcing bars, and a horizontal crossbeam 5 interconnecting the risers 4 and supporting the door drive assembly, and having the top edge of the curtain 1 fixed thereto. The drive assembly comprises the winding shaft 3 which is mounted to rotate freely in at least two supports 6 fitted with ball-bearings 6', together with an electric motor 7 which is coupled via a stepdown gear 8 whose axis is parallel to the axis of the shaft 3, said motor driving said shaft via a transmission chain 9 and a pair of sprocket wheels 9' and 9''. The drive assembly also includes an emergency manual actuator device 10 comprising a rod and an angle coupling enabling the shaft 3 to be rotated via the stepdown gear 8. There is also an end-of-stroke assembly 11 for stopping the motor 7 when the door is fully open and when it is fully closed. This end-of-stroke assembly may be of various different types, known per se. For example, it may comprise a rod or shaft supporting a cam which is rotated simultaneously with the shaft 3. The cam acts on an electric contact of a counter which increments or decrements by one unit for each turn of the camshaft (depending on its direction of rotation) and which stops the motor 7 when a reference value corresponding to a limiting position of the curtain is reached. The end-of-stroke assembly shown in FIG. 1 comprises a threaded rod 12 constituting an endless screw parallel to the shaft 3 which is rotated by said shaft via a transmission chain 13 and two sprocket wheels 13' and 13''. This threaded rod moves a cursor 14 to left or to right depending on the direction of rotation of the winding shaft 3, and the cursor controls top and bottom end-of-stroke switches 15 and 16 which interrupt the power supply to the motor 7 whenever the cursor 14 presses against one or the other of them.

Although the door described above is a particular embodiment and the disposition of its various parts could be varied (the motor could be fixed along one of the risers, so that its axis is perpendicular to the axis of the winding shaft, for example), it nevertheless remains true that all lifting curtain doors include similar supports and drive means for their winding shafts. However, as can be seen from the above description, such apparatus includes numerous parts: there are support parts per se, such as the crossbeam 5, the supports 6, and the ball-bearings 6'; there are transmission and stepdown parts such as the stepdown gear 8, the transmission chains 9 and 13, and the sprocket wheels 9' and 9'' and 13' and 14''; and there are driving or control parts such as the motor 7 and the end-of-stroke means 11. In practice, this set of parts constitutes an operating minimum and various other support parts (in particular the crossbeam 5) and fixing parts necessary for assembling said operating parts are required in order to be able to fit doors to spaces of given dimensions. Naturally, consideration time and manpower are required to make such additional parts and to mount the above-mentioned set of parts carefully, since they need to be positioned relative to one another quite accurately. In addition, the provision of numerous transmission members and of multiple fixing points increases the risk of subsequent breakdown.

The aim of the present invention is to remedy these drawbacks. The present invention seeks to provide a support and transmission module for the winding shaft of a lifting curtain door which, in combination with another module of the same type, replaces the crossbeam 5, the supports 6 together with their bearings 6', the sprocket wheels 9' and 9'' and 13' and 13'' together with their transmission chains 9 and 13, and the stepdown gear 8 of doors as presently manufactured, thereby providing means which can be easily and quickly installed, which are capable of industrial prefabrication, and which are completely reliable. In addition, the invention provides numerous variants of such a module suitable for shafts of any length, and in particular very long shafts comprising a plurality of lengths, and also shafts which deform as they rotate (which happens to shafts used for winding up lifting straps, in particular).

SUMMARY OF THE INVENTION

According to the invention, a support and transmission module for the winding shaft of a lifting curtain door which is rotated by an electric motor, said door being provided with an end-of-stroke device of the type including a rod driven in rotation (a camshaft or a threaded rod moving a cursor between two contacts, for example) comprises:

a closed case;

at least two parallel module shafts, namely a primary shaft having one end projecting outside said case and collinearly connectable to the outlet shaft of the motor (or to the rod of the end-of stroke device), which motor (or which end-of-stroke device) is situated outside said case, and a secondary shaft having one end projecting outside said case and collinearly connectable to the winding shaft;

transmission and velocity ratio means connected to said module shafts, e.g. meshing gearwheels, to transmit the motor-generated torque (or the rotation of the winding shaft) to the winding shaft (or to the rod of the end-of-stroke device) and to step down the speed of rotation of said motor (or of said winding shaft);

bearings means such as ball or roller bearing to allow the module shafts to rotate freely; and bearing supports for supporting said bearing means.

Preferably, both ends of the secondary shaft of the module project outside the case and are collinearly connectable to respective ones of two successive lengths of the winding shaft, said module providing a joining function in addition to its support and transmission functions.

The connection between the winding shaft and the secondary shaft of said module may be provided by means of a coupling member capable of absorbing the deformations to which said winding shaft may be subject while being rotated. Advantageously, the coupling member comprises a male part and a female part, said male part comprising two truncated pyramids meeting by their large bases, and the female part including a bore of substantially constant cross-section which is geometrically similar to the bases of said truncated pyramids. Advantageously, the bases of the truncated pyramids constituting the male part are square.

The invention also provides an actuator system for a lifting curtain door, the system comprising:

a winding shaft optionally comprising two or more lengths;

a motor for driving said winding shaft;

an end-of-stroke device of the type including a rotary-actuated rod;

two end modules for supporting the ends of the winding shaft; and optionally at least one intermediate module supporting the junction between the respective ends of two consecutive shaft lengths, one of the end (or intermediate) modules also providing stepped-down transmission to said shaft of the rotation generated by said motor, one of the end (or intermediate) modules also providing stepped-down transmission of the rotation of said shaft to the rotary-actuated rod of the end-of-stroke device.

BRIEF DESCRIPTION OF THE DRAWINGS

Embodiments of the invention are described by way of example with reference to the acompanying drawings in which.

MORE DETAILED DESCRIPTION

Figure 1:
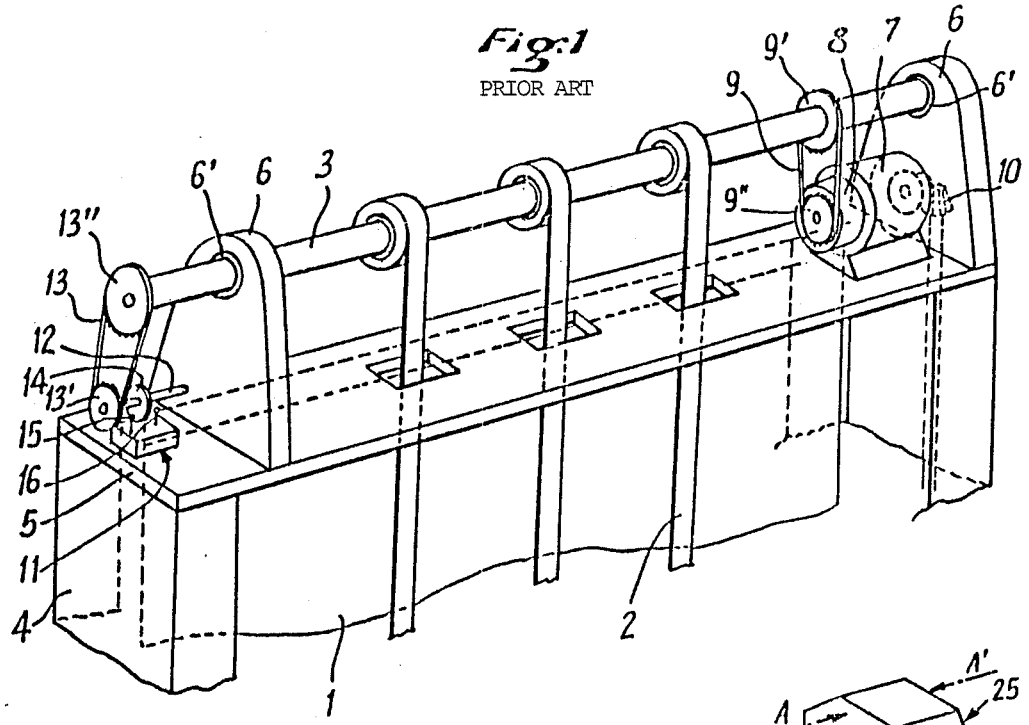
Fig:1 PRIOR ART
FIG. 1 shows a perspective view of the prior art as described above.
Figure 2:
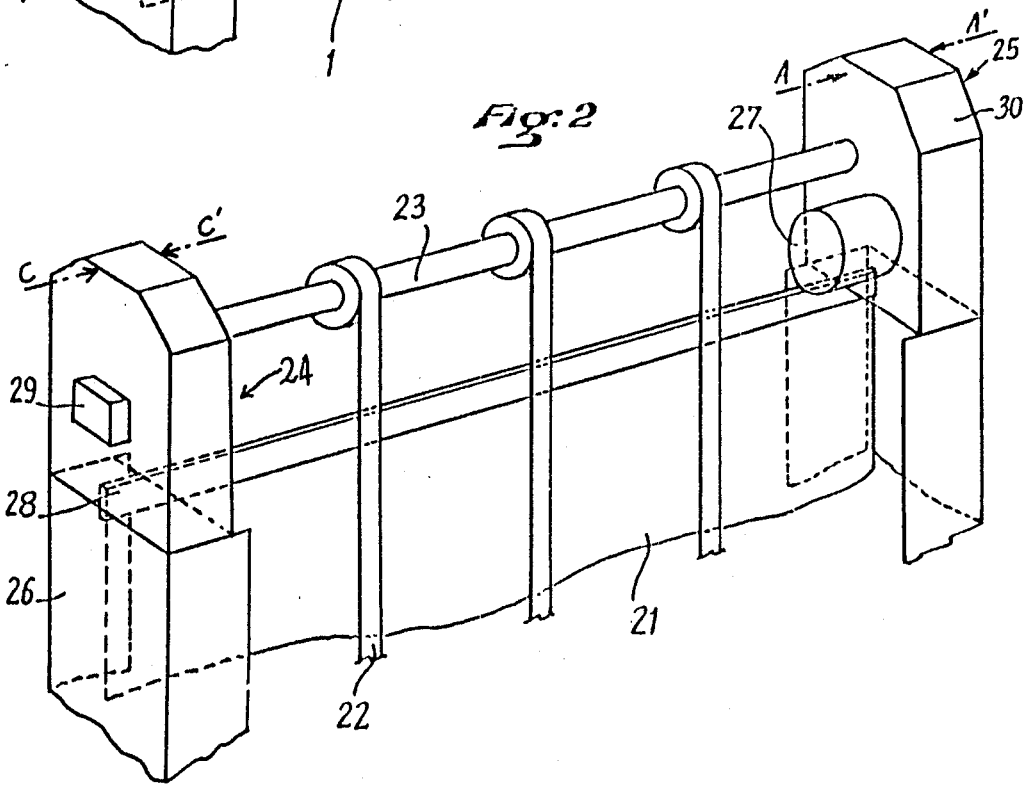
FIG. 2 show a perspective view of the actuating system for a goods handling door including two support and transmission modules in accordance with the present invention.

FIG. 2 shows the top portion of a goods handling door whose flexible curtain 21 is raisable by means of straps 22. The top ends of the straps are fixed to a one-piece winding shaft 23 which is supported by two modules 24 and 25. Each end of a bar 28 from which the curtain 21 is suspended is fixed to one of the risers 26 of the door or to one of the modules 24 and 25. An electric motor 27 is fixed to the module 25, and the module 24 supports an end-of-stroke box 29 of the type including a rotary-actuated rod (a camshaft or a threaded rod displacing a cursor between two contacts, for example).

Figure 3:
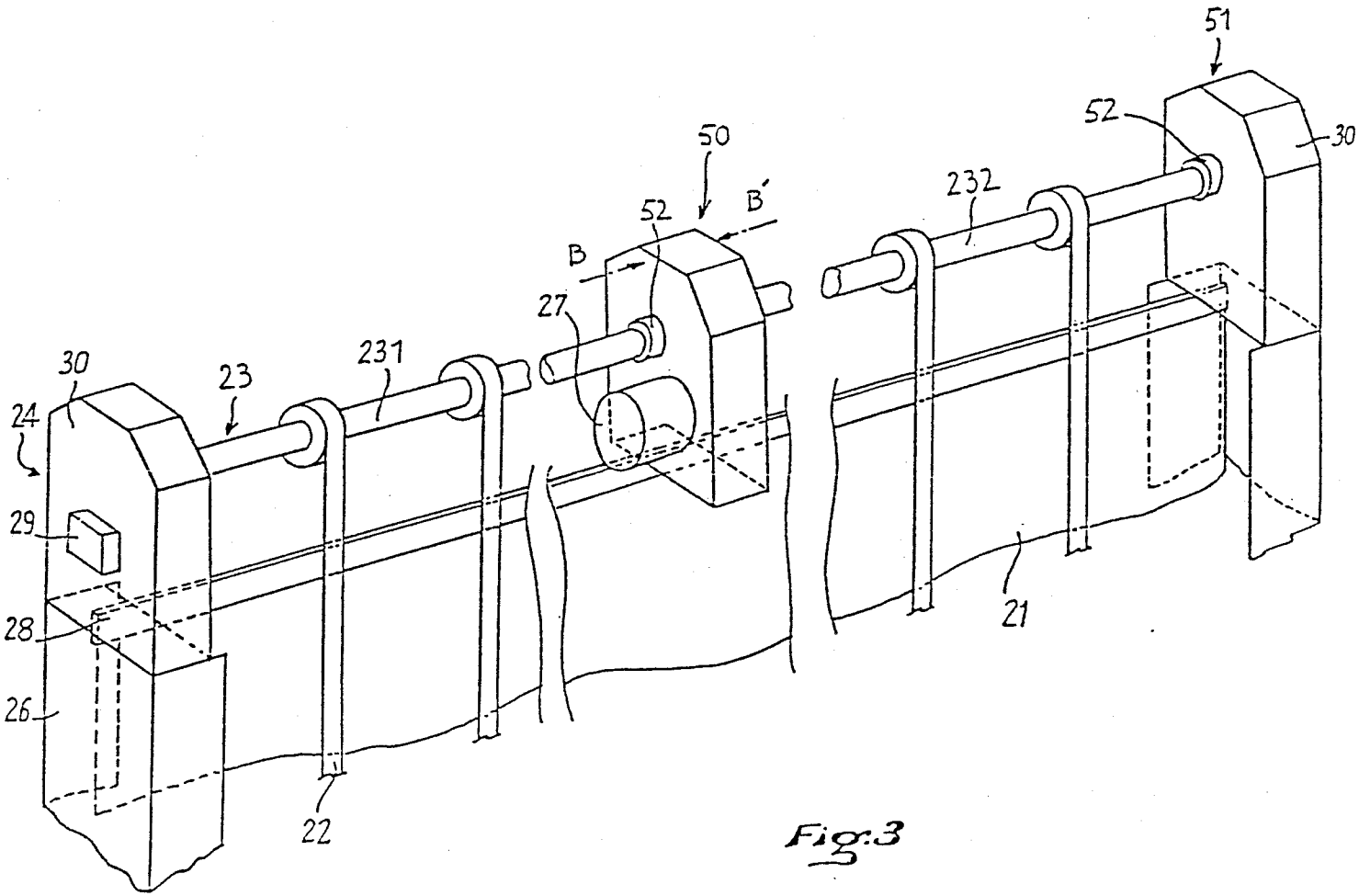
FIG. 3 shows a perspective view of the actuating system of a very wide goods handling door including three support and transmission modules in accordance with the invention.

FIG. 3 shows the top portion of a handling door of the same type as that described above but of such a width that its winding shaft needs to be supported at three points. Such handling doors are intended for use in warehouses, industrial premises and the like, and it often happens that they are very wide, in which case their winding shafts need to be supported at more than two points.) The shaft of this door comprises two lengths 231 and 232 whose ends are supported by three modules 24, 50, and 51.

In a common disposition as shown in FIGS. 2 and 3, end modules such as 24, 25, and 51 are disposed on top of door risers 26. If the risers are dimensioned so as to be capable of supporting the door operating system (i.e. all of the parts necessary for actuating the curtain: the motor, the winding shafts, the supports and various bearings, etc.) and therefore do not serve solely as guides for the side edges of the curtain 21, then end modules such as 24, 25, and 51 may be fitted directly to said risers. Otherwise they may be fixed to the masonry through which there is the doorway to be closed by the door. The intermediate module 50 is fixed to the masonry either directly, or else via struts or hangers.

In another disposition (not shown) which is particularly advantageous when door height is limited, for example because of the configuration of the building in which it is installed, and because it is desirable to install an opening which is as large as possible, the end modules need not be placed on top of the door risers but may be placed against said risers near their tops. Angle transmissions are then provided in order to deflect the straps. Any intermediate module(s) may be fixed by means of struts or hangers to the wall against which or in which the door is mounted.

Figure 4:
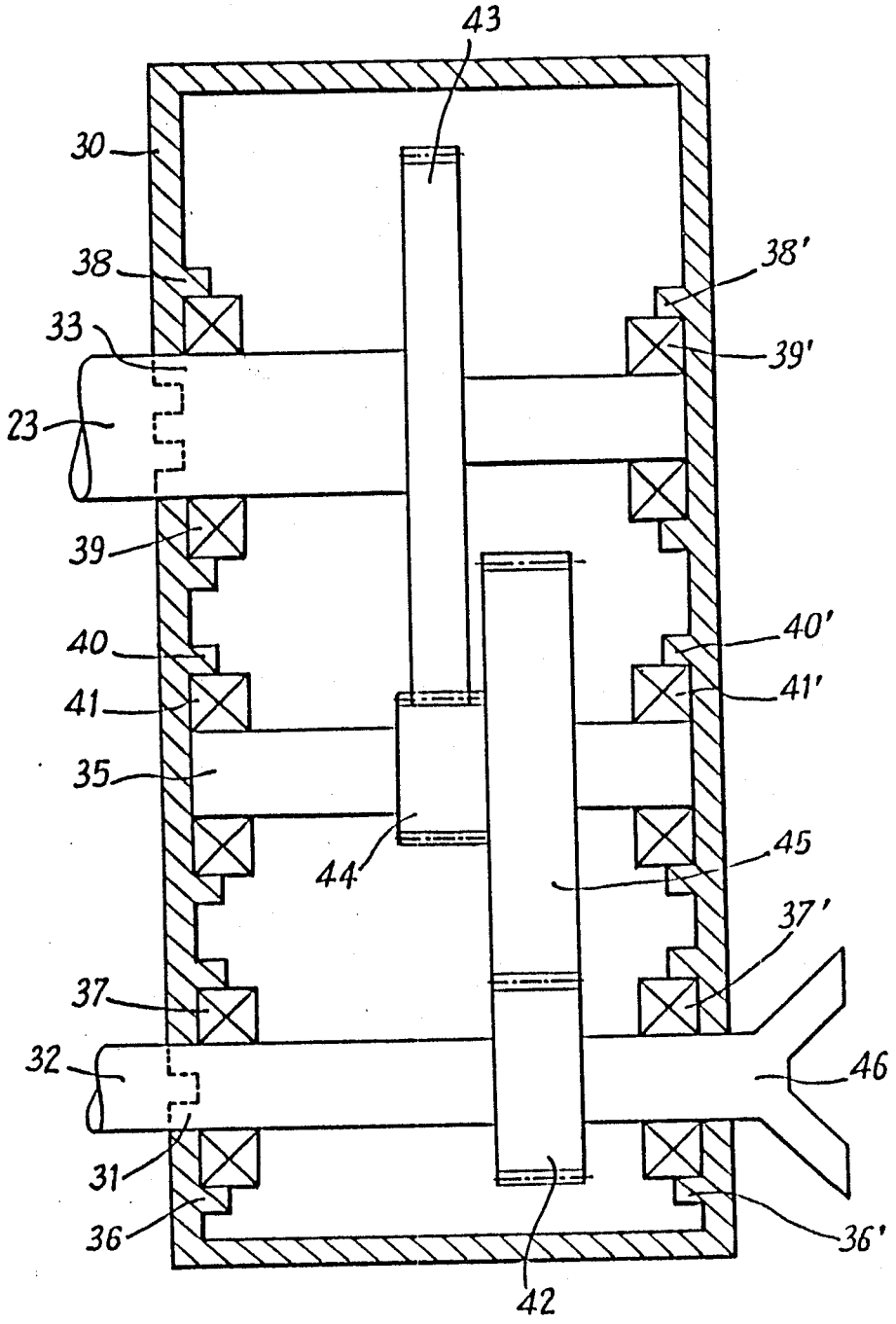
FIG. 4 shows a cross-section on a vertifical plane through line A—A′ of FIG. 2 through a first support and transmission module in accordance with the present invention.

FIG. 4 is a section through the module 25 on a vertical plane including A—A′ of FIG. 2. This module comprises a metal case 30 which is advantageously cast, and inside which there are three shafts disposed in parallel: a primary shaft 31 which is collinearly connected to the outlet shaft 32 of the motor 27, advantageously by means of a rapid connection of the type having a male profile received in a corresponding female profile, for example (a connection of the rigid type as shown diagrammatically in the figure is suitable, in fact, only for shafts which do not deform while rotating, as described below); a secondary shaft 33 which is collinearly connected to the winding shaft 23, likewise preferably by rapid connection means of the type comprising a male profile received in a corresponding female profile; and an intermediate shaft 35 which does not have a linear connection. The shafts 31, 33, and 35 are held in supports 36 and 36', 38 and 38', and 40 and 40'which are advantageously integrally molded on the inside surface of the case 30, with ball or roller bearings 37 and 37', 39 and 39', and 41 and 41' being interposed between the supports and the shafts. The primary shaft 31 and the secondary shaft 33 carry respective gearwheels 42 and 43 with the diameter of the gearwheel 42 being small relative to the diameter of the gearwheel 43, and the intermediate shaft carries two gearwheels 44 and 45 to co-operate respectively with the gearwheels 43 and 42, the diameter of the gearwheel 44 being small relative to the diameter of the gearwheel 45. The assembly constituted by the intermediate shaft 35 and its gearwheels 44 and 45 thus provides transmission of the torque generated by the motor 27 to the winding shaft 23 while simultaneously stepping down the speed of rotation of the outlet shaft 32 of the motor to some extent. The complete stepdown system which includes two stepdown stages is constituted by the set of gearwheels 43, 42, 44, and 45 whose respective diameters are chosen so as to obtain the appropriate stepdown ratio. This stepdown gear system which in some mechanical configurations need have only one stage and which, in contrast, in other systems may require more than two stepdown stages in order to divide the speed of rotation of the electric motor, is also used for the purpose of manually raising the curtain in the event of a motor breakdown. To achieve this end, the end of the primary shaft 31 which is not connected to the outlet shaft 32 of the motor projects outside the case 30 and is provided with a conical gearwheel 46 (or with any equivalent device) providing an angled transmission with a corresponding gearwheel or other member (not shown) fixed at the end of a rod whose other end includes a handle.

Figure 5:
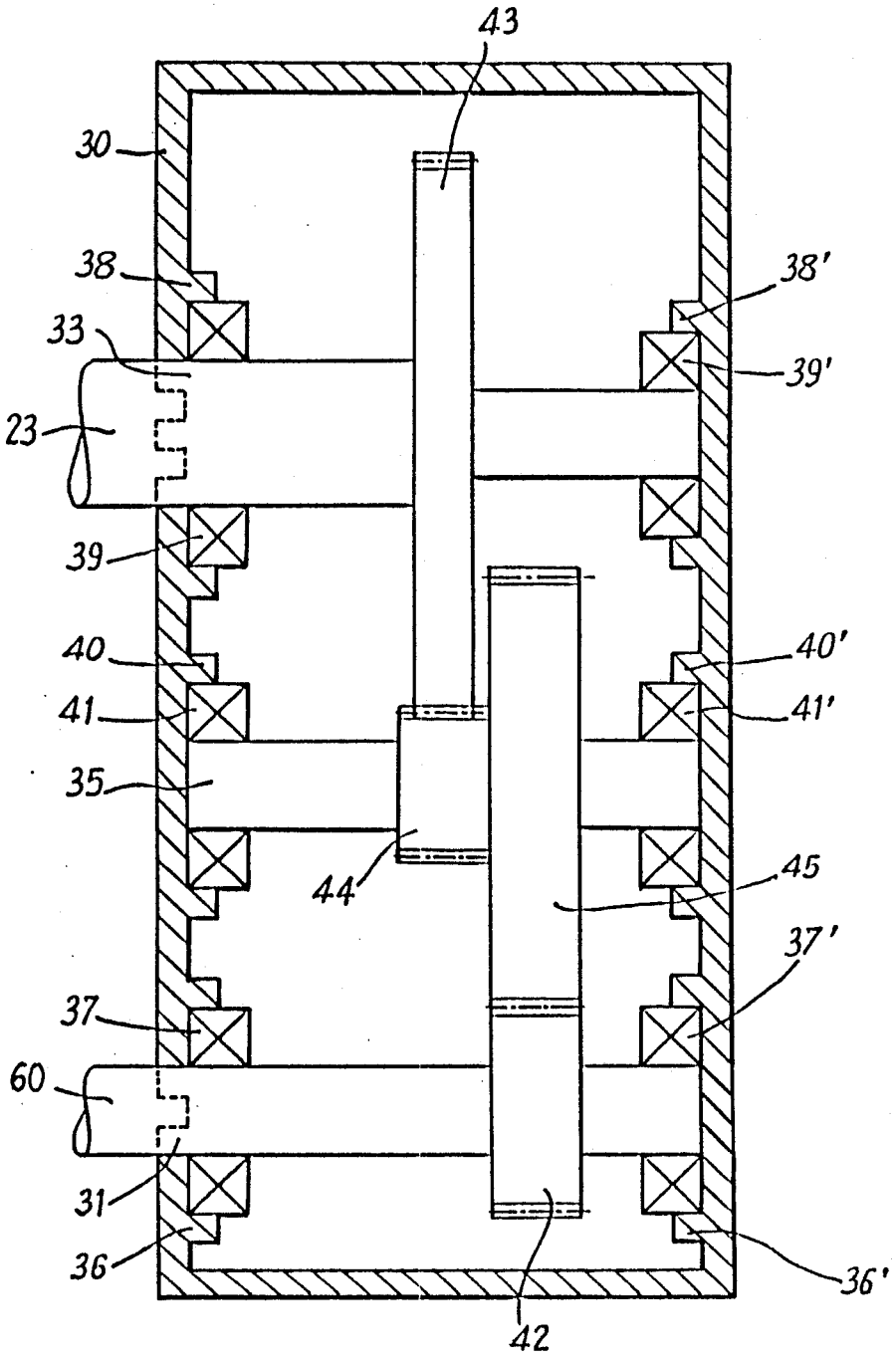
FIG. 5 shows a cross-section on a vertical plane through line C—C′ of FIG. 2 through a second support and transmission module in accordance with the present invention.

The module 24 shown in FIG. 5 is similar to the module 25 (and the same reference numerals are used to designate identical parts). It likewise comprises a case 30 having at least two shafts fitted with gearwheels of appropriate diameters maintained parallel therein: a primary shaft being connected to a rotary drive rod 60 (a threaded rod, a camshaft, etc.) of an end-of-stroke device 24; a secondary shaft being connected to the winding shaft 23; and one or more optional intermediate shafts provided with gearwheels of appropriate diameters to convey rotary transmission from the secondary shaft to the primary shaft with an appropriate velocity ratio if the speed of rotation of the winding shaft 23 does not match the speed required to operate the end-of-stroke device. In this module, only one end of the primary shaft 31 projects outside the case 30.

In the above-described modules 25 and 24, the torque generated by the motor is transmitted and its speed of rotation is reduced by gearwheels which co-operate by meshing. Although less advantageous, it is also possible to provide the velocity ratio function by sprocket wheels having different diameters and the transmission by chains which co-operate with said sprocket wheels. The term "toothed wheel" is used below to cover both gear wheels and/or sprocket wheels, as appropriate.

The modules 24 and 25 are sealed against damp and dust, and lubrication is advantageously provided therein by a bath of oil, with the viscosity of the oil being chosen as a function of the temperature conditions under which the door operating system concerned is to operate. Naturally, the lubrication could also be provided by means of a suitable grease being applied to the gearwheels and the bearings during assembly.

By virtue of the above-described support and transmission module, it is possible to provide an actuating system for a lifting curtain door of medium size comprising only five parts or components, namely: the winding shaft; the two modules; a motor; and an end-of-stroke device. This actuating system is self-supporting, i.e. it does not require fixing to a lintel-forming beam as is required by prior art actuating systems, which include a much greater number of parts. This system is also very easy to assemble and, given its simplicity and its compactness, it is very reliable.

However, the module described above is suitable only for supporting winding shafts of medium length, i.e. shafts which do not require support at points other than at their ends. In addition, it is not directly usable with highspeed doors comprising a flexible curtain optionally stiffened at regular intervals by horizontal reinforcing bars and which are raised by winding straps around a shaft, regardless of whether the curtain folds concertina-like or whether it is wound round a bar fixed to its bottom end. With doors of this type, unlike doors for providing protection and comprising an articulated metal curtain which is wound directly on a shaft driven at low speed by a motor, the shaft for winding up the straps rotates rapidly and it is not kept rectilinear by a curtain which is rigid in a direction parallel to its axis and which is being wound thereabout. By virtue of the speed of rotation which is applied thereto and the load which it has to carry at a few points only (the points where the straps are attached), a highspeed shaft deforms as it rotates, thereby inevitably breaking its couplings to the secondary shafts of the end support modules unless the winding shaft has been specially shaped. This applies particularly to rigid connections or couplings.

The three modules 24, 50, and 51 shown in FIG. 3 are designed to support a long shaft 23 comprising two lengths 231 and 232 and rotated rapidly to wind lifting straps 22 up or down. It therefore deforms as it rotates and thus requires a special type of module for support purposes.

In addition to supporting one end of the half-shaft 231, the end module 24 provides stepped-down transmission of the rotary motion of said half-shaft to the rod (threaded rod or camshaft) of an end-of-stroke device 29. The end module 51 serves to support one end of the half-shaft 232. It may also include a simple gear system meshing with the half-shaft 232 and manually driveable by means of an angle coupling, a rod, and a handle (not shown). These two modules differ from the above-described modules in that they include coupling members 52 for connecting their secondary shafts to corresponding ends of each of the half-shafts.

Figure 6:
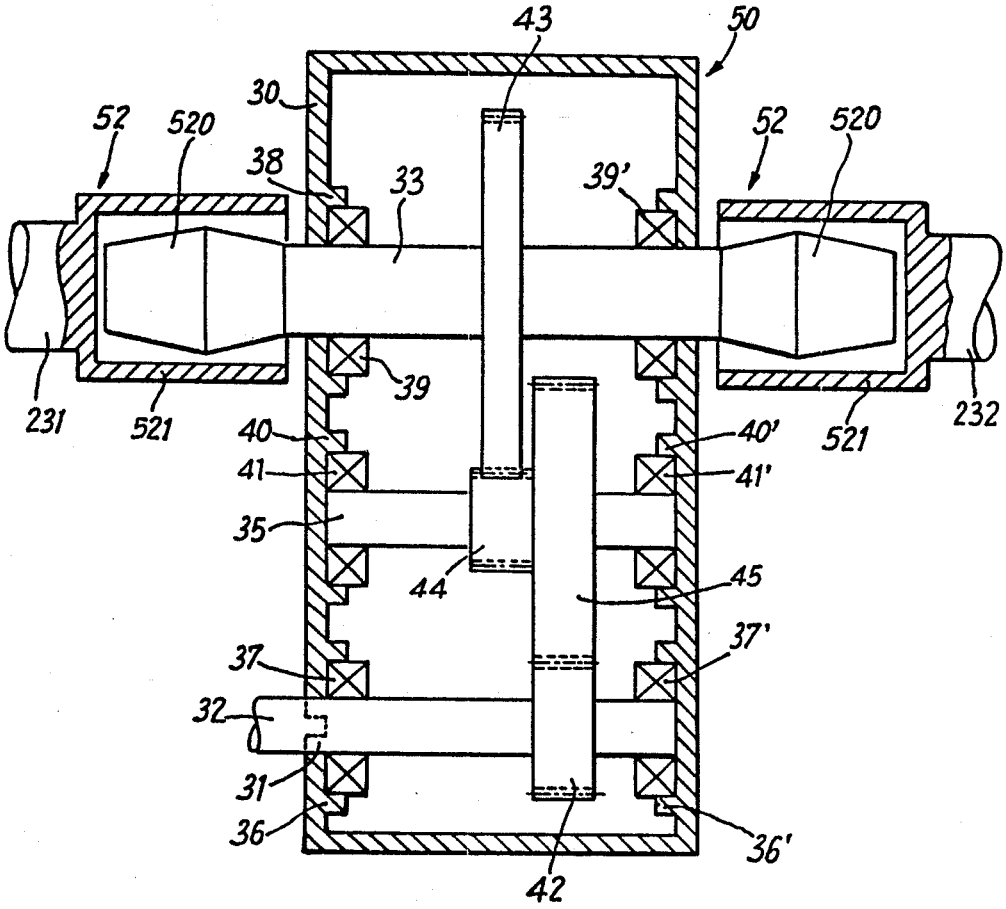
FIG. 6 shows a cross-section on a vertical plane through line B—B′ of FIG. 3, through a third support and transmission module in accordance with the present invention.
Figure 7:
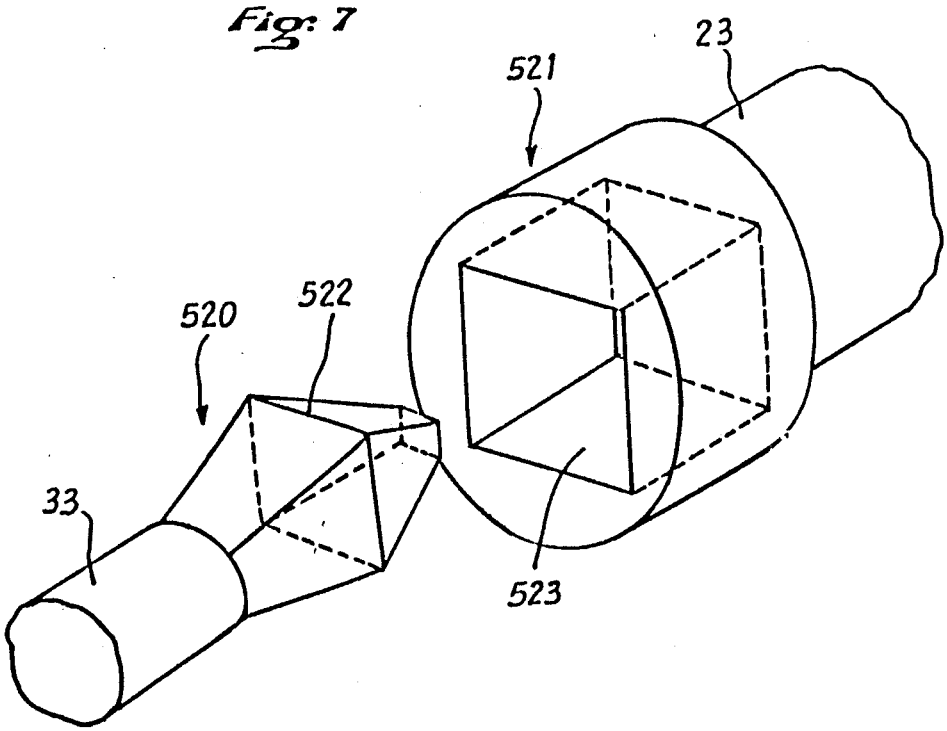
FIG. 7 show a perspective view of one embodiment of a coupling in accordance with the present invention between a module and a winding shaft.

The intermediate module 50 which FIG. 6 shows in section on a plane including line B—B' of FIG. 3, serves to support the other ends of each of the half-shafts 231 and 232 and also to provide stepped-down transmission to said half-shafts of rotation generated by the motor 27.

This module differs from the module described with reference to FIG. 4 in that:

only one end of its primary shaft projects outside the case 30, and this end is connected to the outlet shaft 32 of the motor 27, advantageously by means of a rapid connection of the type where a male profile is received in a corresponding female profile, for example; and both ends of its secondary shaft project outside the case 30, with these two ends being connected via respective coupling members 52 to respective ones of the half-shafts 231 and 232.

As explained above, a shaft for winding the straps of handling doors deforms as it rotates, and there is no preferred direction of deformation. This means that it is not possible for the connection between the secondary shaft 33 of any of the modules (be it a support and transmission module such as the modules 24 and 25, or a support-only module such as the module 51) and the winding shaft of a door of this type to be a rigid connection, since experience shows that such rigid connections lead to very rapid deterioration of the modules. That is why this connection is established by means of a coupling member capable of absorbing any deformation in the strap-winding shaft. This coupling member may be a universal joint. It may also be a flexible coupling device of a type known per se, for example a device comprising two metal disks one of which is provided with radial projections and the other of which is provided with corresponding radial grooves, said grooves being larger in size than said projections and containing cushions made of a resilient synthetic material each having a slot via which it co-operates with one of said projections. Prior flexible coupling devices and universal joints are thus capable of solving the problem, however they generally suffer from being quite expensive. A coupling member has therefore been designed for this particular application, which coupling member is both effective and very easy to manufacture.

As can be seen in FIGS. 5 and 6, a coupling member in accordance with the invention comprises a male part 520 and a female part 521 which are fixed respectively on the end of the secondary shaft 33 of a module and on the end of a winding shaft (or length of winding shaft) 23, with a connection the opposite way around being equally possible. This male part 520 is in the form of two truncated pyramids meeting via their large bases. For ease of machining, it is preferable for the bases 522 of these truncated pyramids to be square. However, any other regular polygonal shape could be envisaged. The female part 521 is constituted by a cylinder having a bore 523 of substantially constant section provided therein, said section being geometrically similar to the bases of the truncated pyramids of the male part 520 and slightly larger. The two parts of this coupling member are made of a metal having good mechanical properties. The secondary shafts 33 of the modules may be formed integrally with the coupling part(s) belonging thereto.

As can be seen from the above description, a module in accordance with the present invention has numerous advantages:

two compact and self-contained modules house a score of different parts;

modules suitable for all types of lifting curtain doors can be prefabricated industrially;

assembly is quick and easy, and maintenance is reduced or unnecessary;

reliability is better than with prior art embodiments;

required manpower time is reduced due to the characteristics mentioned above; and space is saved due to the compact nature of such modules.

The present invention is not limited to the embodiments described above; it may be modified or varied by persons skilled in the art.

I claim:

1. A support and transmission module for a winding shaft (23) of a lifting curtain door, said winding shaft being in at least one piece, said module comprising:

a casing (30) having a first face and first and second apertures;

at least primary and secondary parallel shafts (31, 33), a first end of said primary shaft projecting through said first aperture, and a first end of said secondary shaft projecting through said second aperture;

transmission and velocity ratio means (42, 43, 44, 45), provided in said casing and connected to said first and second shafts for transmitting rotational motion between said primary and secondary shafts;

an electric motor (27) for imparting rotation to said winding shaft;

means for fixing one of said electric motor and a limit switch (29) to said first face of said casing; and means (52), connected to said first end of said secondary shaft, for connecting and supporting one end of said winding shaft, wherein said support and transmission module is sufficiently self-contained to be connectable operably to said winding shaft as a unit.

2. A support and transmission module according to claim 1 wherein said casing includes a third aperture, in register with said second aperture, a second end of said secondary shaft protruding through said aperture, said module further including means (52), connected to the second end of said secondary shaft, for connecting and supporting the other end of said winding shaft.

3. A lifting curtain door assembly, comprising:

a lifting curtain door (21);

at least one winding shaft (23) which is in at least one piece, said winding shaft being attached to said lifting curtain door;

a casing (30) having a first face and first and second apertures;

at least primary and secondary parallel shafts (31, 33), a first end of said primary shaft projecting through said first aperture, and a first end of said secondary shaft projecting through said second aperture;

transmission and velocity ratio means (42, 43, 44, 45), provided in said casing and connected to said primary and secondary shafts, for transmitting rotational motion between said primary and secondary shafts;

an electric motor (27) for imparting rotation to said winding shaft;

means for fixing one of said electric motor and a limit switch to said first face of said casing; and means, connected to said first end of said secondary shaft, for connecting and supporting one end of said winding shaft, said assembly further comprising a coupling device, said couping device comprising in turn said connecting and supporting means, a male part (520) and a female part (521), said male part comprising two truncated square pyramids connected at respective larger cross-sectional portions thereof, said female part including a bore of substantially square constant cross-section and receiving said male part.

4. A support and transmission module for a winding shaft (23) of a lifting curtain door (21), said winding shaft being in at least one piece, said module comprising:

a casing (30) having a first face and first and second apertures;

primary and secondary parallel shafts (31, 33), disposed in said casing, one end of said primary shaft protruding through said first aperture and one end of said secondary shaft protruding through said second aperture;

means (42, 43, 44, 45), disposed within said casing, for transmitting rotational motion between said primary and secondary shafts;

an electric motor (27);

means, provided on said first face of said casing, adjacent said first aperture, for fixing an electric motor thereto; and means, provided on said end of said secondary shaft, for connecting and supporting one end of said winding shaft;

said casing further including a third aperture, in register with the said first aperture, a second end of said primary shaft extending through said aperture, said module further including means, connected to said second end of said primary shaft, for manually operating said primary shaft.

* * * * *